United States Patent [19]

Thompson

[11] Patent Number: 4,703,665

[45] Date of Patent: Nov. 3, 1987

[54] WELL PUMPING UNIT

[75] Inventor: James E. Thompson, Dallas County, Tex.

[73] Assignee: USX Corporation, Pittsburgh, Pa.

[21] Appl. No.: 921,578

[22] Filed: Oct. 22, 1986

[51] Int. Cl.[4] ..... F04B 47/02

[52] U.S. Cl. ..... 74/41

[58] Field of Search ..... 74/41, 108

[56] References Cited

U.S. PATENT DOCUMENTS

| | | | |
|---|---|---|---|
| 1,890,807 | 12/1932 | Faber | 74/41 |
| 2,079,276 | 5/1937 | Bloss | 74/41 |
| 2,153,094 | 4/1939 | Maier | 74/41 |
| 2,515,360 | 7/1950 | Vail | 74/41 |
| 3,310,988 | 3/1967 | Gault | 74/41 |
| 4,505,162 | 3/1985 | Hoh et al. | 74/41 |

*Primary Examiner*—Lawrence Staab

*Attorney, Agent, or Firm*—William F. Riesmeyer, III

[57] ABSTRACT

A pumping unit has a short base frame and interchangeable crank arms, while retaining a relatively low net peak torque requirement obtained through a slower upstroke and a faster downstroke.

4 Claims, 5 Drawing Figures

WELL PUMPING UNIT

BACKGROUND OF THE INVENTION

This invention relates to well pumping units for reciprocation of a downhole pump and, particularly, to an improvement in the design of such units for decreasing the cost of operation and manufacture of them.

The conventional well pumping unit includes a walking beam rotatably mounted on a saddle bearing located at the upper end of a samson post. An arc is attached to the end of the walking beam. The arc is adapted for connection to a string of sucker rods extending downwardly in a well to a downhole pump. A motor-driven rotary crank oscillates the walking beam through a pitman rotatably connected at one end to the walking beam by a tail bearing and at the opposite end to the crank by a wrist pin. A counterweight attached to the crank assists the motor in oscillating the beam on the upstroke of the well string. The conventional units often have a pair of cranks, each having a counterweight attached, and a pitman connected to each crank and the walking beam.

It is known that the peak torque load on the motor can be reduced by modification of the dimensions and placement of the various parts of the pumping unit. By virtue of such modifications, it is possible to slow the upstroke of the well string and decrease the peak torque load required to be exerted by the motor on the crank. The slower upstroke is evidenced by the fact that it occurs on more than a 180 degree portion of rotation of the crank, whereas the resultant faster downstroke occurs on a commensurately less than 180 degree portion of crank rotation. An example of such a modified pumping unit is disclosed in U.S. Pat. No. 3,406,581, Eyler, et al. The crank in the pumping unit of this reference is located so that the entire circle of rotation of the wrist pin lies to the rear and out from under the area directly beneath the operating arc of the tail bearing. The slower upstroke which results is illustrated by the fact that it occurs over a 210 degree portion of the arc of rotation of the crank, compared to a 150 degree portion of the arc for the downstroke.

It is also well known in the art to use an angularly offset wrist pin connection between the pitman and the crank so that the maximum assist from the counterweight to the motor is obtained when the well load is at its highest level. To accomplish this, the counterweight should be located so that its center of gravity is at either the 3 o'clock or 9 o'clock position on the circle of rotation of the crank when the well string is at the midpoint of its upstroke. The previously mentioned change in the circle of rotation of the wrist pin as disclosed in Eyler, et al. requires a change in the phase or timing of the maximum force exerted by the counterweights with respect to the well load. An angularly offset wrist pin can be used as disclosed in Eyler, et al. to obtain most efficient utilization of the motor torque and to decrease the peak torque load required from the motor. A significant disadvantage of the well pumping units disclosed in the Eyler, et al. reference is that the distance between the motor and the samson post is increased from that of prior units. Because of this increased distance, a longer bottom frame is required increasing the cost of the unit. Also, a longer concrete base is needed for support of the frame, increasing the cost of installation. A second disadvantage results from the use of an angularly offset wrist pin on these units. The casting for the two crank arms are not interchangeable because the wrist pin of one crank arm would be in the wrong location for the other. Thus, separate castings must be provided for each crank arm on a twin crank arm unit of this type.

Therefore, it is a primary object of this invention to overcome the aforementioned disadvantages of prior art pumping units, while retaining the advantages of a slower upstroke and proper positioning of the counterweight so as to obtain the maximum assist by the counterweight to the motor when the well string is at the midpoint position of its upstroke.

SUMMARY OF THE INVENTION

The invention is of a pumping unit having a shorter base frame and interchangeable crank arms, while retaining a relatively low net peak torque requirement obtained through a slower upstroke and a faster downstroke. These advantages can be obtained in both the rear mounted and front mounted geometry systems with crank counterbalance. An essential feature of the pumping units of this invention is that the axis of the wrist pin connection between the pitman and the crank intersects a straight line direction extending through the center of gravity of the counterweight and along the axis of the crank arm to an intersection with the axis of the motor-driven spindle which rotates the crank arm. This feature permits interchange of crank arm castings in a dual crank arm unit since each casting is identical.

DESCRIPTION OF THE PREFERRED EMBODIMENT

Figure 3:
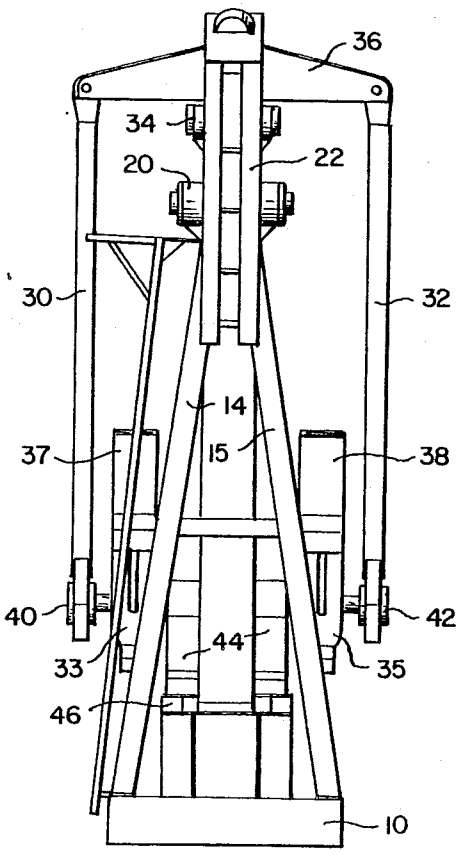
FIG. 3 is an end view of the pumping unit of FIG. 1.
Figure 1:
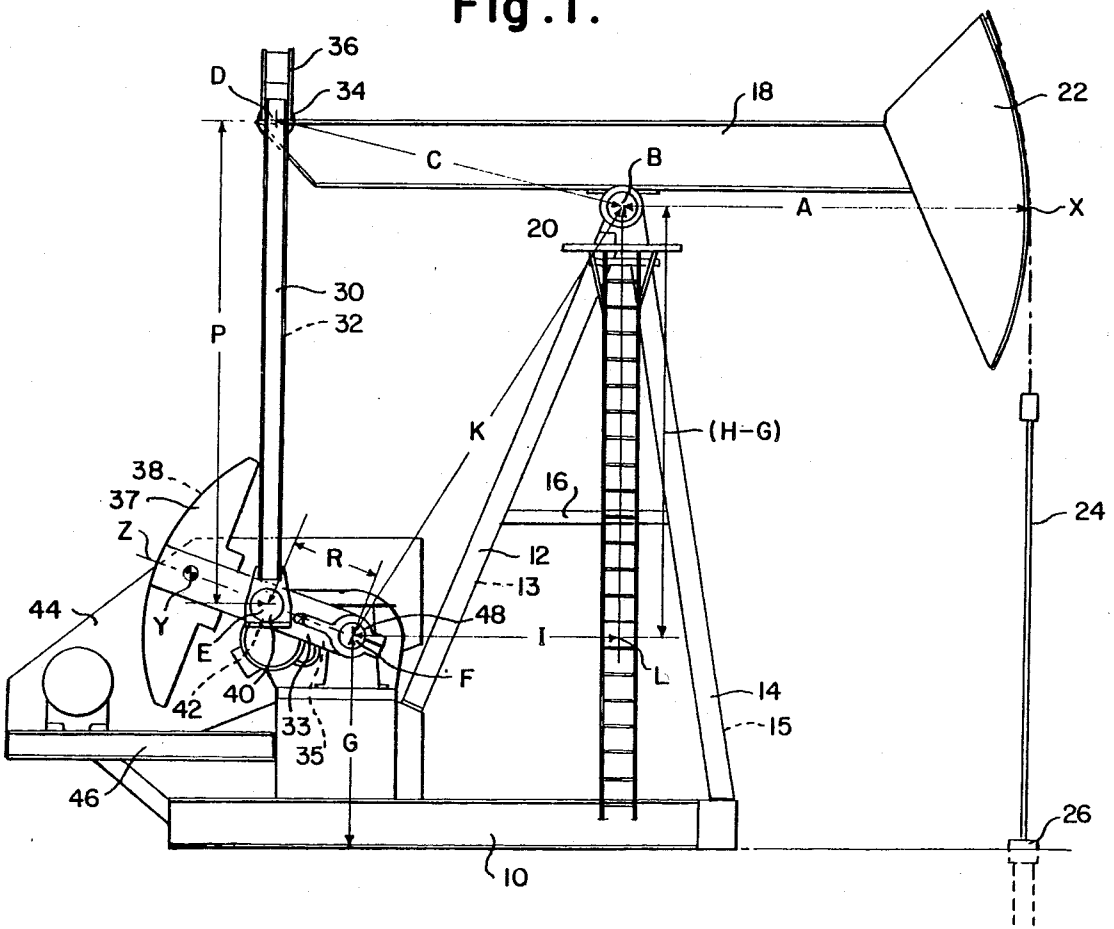
FIG. 1 is a side elevation view of a rear mounted geometry pumping unit according to this invention.
Figure 2:
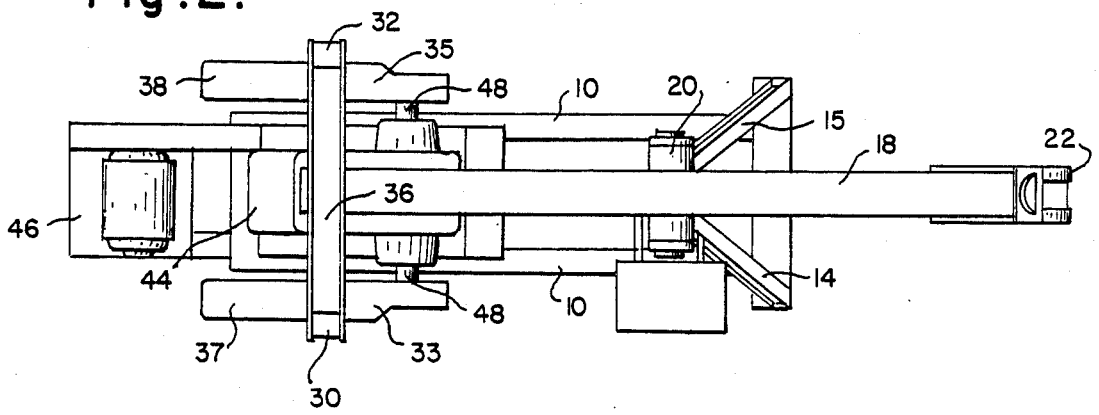
FIG. 2 is a plan view of the pumping unit of FIG. 1.

Referring to FIG. 1, a conventional rear mounted geometry pumping unit includes a metal base or frame 10 generally fabricated of structural steel members and plates. A samson post is mounted on the frame and comprises upright members 12 and 14 with one or more cross braces 16 attached if required for structural stability. A walking beam 18 is rotatably mounted in an elevated position on the samson post in saddle bearing 20. An arc 22 is attached to one end of walking beam 18 and is adapted for connection to a production string 24 extending downwardly into well 26. A pair of pitmans 30 and 32 are rotatably mounted in tail bearing 34 through equalizer beam and connector structure 36 at the opposite end of walking beam 18. Means for oscillating walking beam 18 through reciprocation of each pitman is provided and includes a pair of crank arms 33 and 35 (FIGS. 2 and 3), each having a counterweight 37 and 38 attached. Each pitman is rotatably connected to a respective one of the crank arms at wrist pins 40 and 42. Motor and gear reducer assembly 44 is mounted on a support table structure 46 located on frame 10. Motor and gear reducer assembly 44 has a driven spindle 48 with each crank arm attached at opposite ends thereof. The pumping unit has certain dimensions which are defined by the distances between the parts as set forth below. The same letter designations will be used for these distances as are used in applicable American Petroleum Institute (API) specifications for pumping units of this type. The distance A extends from the axis B of saddle bearing 20 to the point of tangency X on the outer surface of the arc which lies in the direction of the well string. The distance C extends in the same plane as A from B to the intersection of a line through the common axis D of tail bearing 34. The distance P extends from D, the axis of the tail bearing to the common axis E of the rotatable connections of each pitman to the respective crank arm to which it is attached at the wrist pin. The distance R extends from E to the axis F of motor driven spindle 48. The distance I extends from F in a horizontal direction to a point L at the intersection of a vertical line drawn through the axis of saddle bearing 20. The distance G extends from F to the ground, i.e. the bottom of frame 10. Finally, the distances H-G and K extend from B to L and from F to B, respectively.

According to this invention, the center of gravity Y (FIG. 1) of counterweight 37 lies in a straight line direction Z extending so as to intersect with the axis of wrist pin 40 and motor driven spindle 48. The center of gravity of counterweight 38 lies in a parallel direction Z (FIG. 1) spaced from the direction Z and extends so as to intersect the axis of wrist pin 42 and motor driven spindle 48. In the case of counterclockwise rotation of the crank arm as viewed in FIG. 1 with the well on the right, the rear mounted geometry pumping unit has the aforementioned distance ratios within the following ranges:

TABLE I

| Rear Mounted Geometry-Counterclockwise Rotation | | |
|---|---|---|
| API Dim. Ratio | Preferred Range | Broad Range |
| A/C | 0.926 to 1.318 | 0.800 to 1.600 |
| R/C | 0.351 to 0.359 | 0.337 to 0.373 |
| P/C | 1.405 to 1.433 | 1.345 to 1.490 |
| K/C | 1.364 to 1.392 | 1.309 to 1.447 |
| (H-G)/C | 1.164 to 1.287 | 1.042 to 1.410 |
| I/C | 0.598 to 0.660 | 0.535 to 1.723 |

In the case of clockwise rotation of the crank arm as viewed in FIG. 1 with the well on the right, the rear mounted geometry pumping unit has the aforementioned distance ratios within the following ranges:

TABLE II

| Rear Mounted Geometry-Clockwise Rotation | | |
|---|---|---|
| API Dim. Ratio | Preferred Range | Broad Range |
| A/C | 0.935 to 1.264 | 0.800 to 1.550 |
| R/C | 0.377 to 0.385 | 0.362 to 0.400 |
| P/C | 1.476 to 1.506 | 1.416 to 1.566 |
| K/C | 1.974 to 2.014 | 1.894 to 2.094 |
| (H-G)/C | 1.710 to 1.744 | 1.468 to 1.986 |
| I/C | 0.987 to 1.007 | 0.847 to 1.147 |

Figure 4:
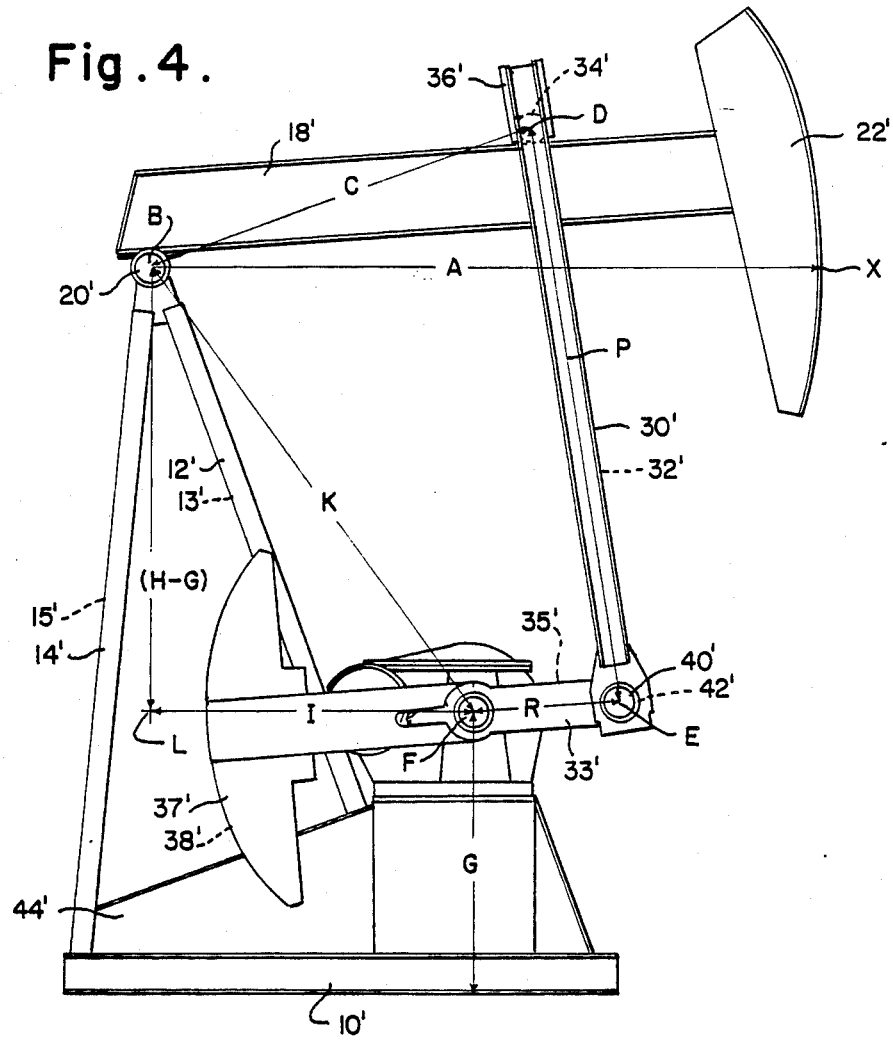
FIG. 4 is a side elevation view of a front mounted geometry pumping unit according to this invention and which is designed for counterclockwise rotation of the crank arm.
Figure 5:
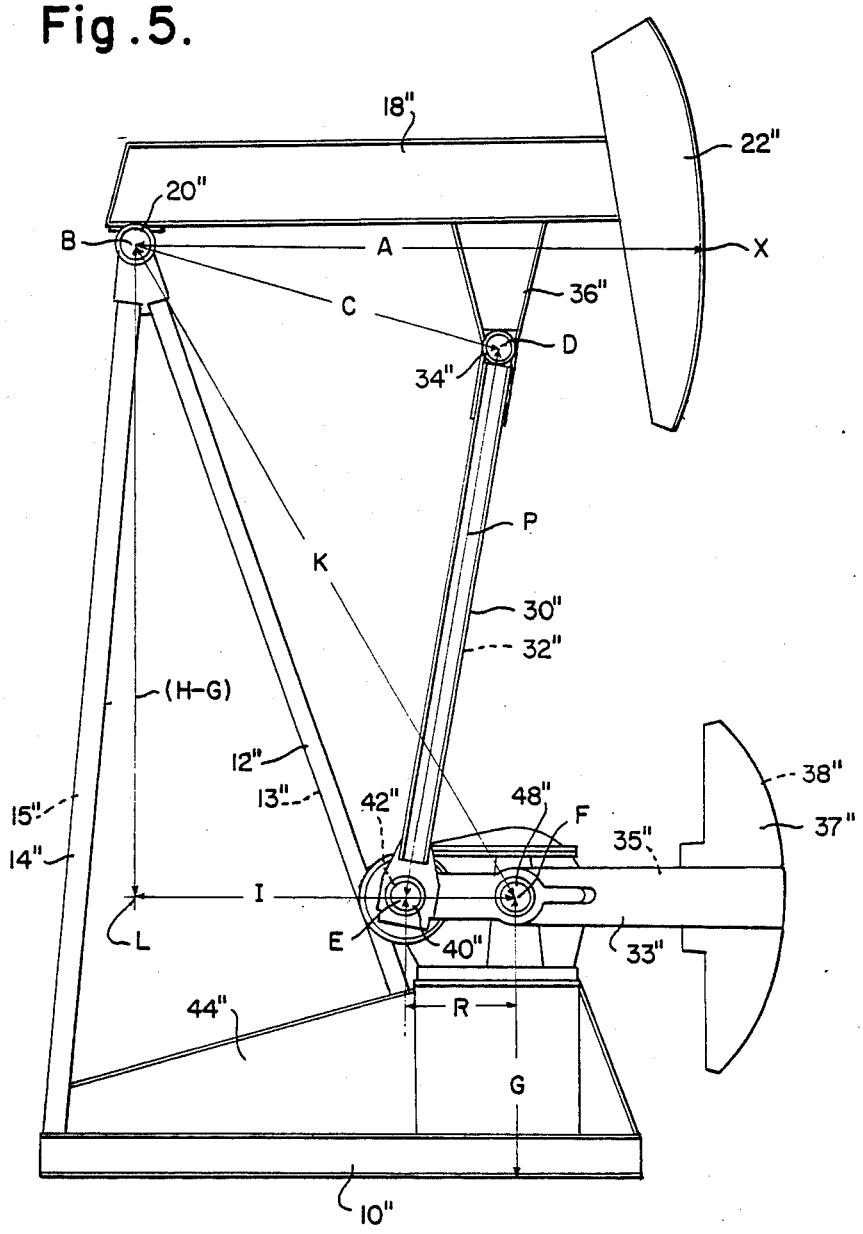
FIG. 5 is a side elevation view of a front mounted geometry pumping unit according to this invention and which is designed for clockwise rotation of the crank arm.

FIGS. 4 and 5 show two front mounted geometry versions of a pumping unit according to this invention. The version shown in FIG. 4 is designed for counterclockwise rotation of the crank arm, whereas the version of FIG. 5 is designed for clockwise rotation. In FIGS. 4 and 5, like parts are given the same numeral designations as in FIGS. 1, 2 and 3 with superscript primes added thereto. In FIG. 4 showing the front mounted pumping unit designed for counterclockwise rotation, the tail bearing is mounted about the walking beam. In FIG. 5 showing the front mounted pumping unit designed for clockwise rotation, the tail bearing is mounted below the walking beam. As in the previous embodiments of the rear mounted geometry, it is essential in the front mounted geometry unit that the axis of the wrist pin connection between the pitman and crank intersects a straight line direction extending through the center of gravity of the counterweight and along the axis of the crank arm to an intersection with the axis of the motor driven spindle which rotates the crank arm (American Petroleum Institute (API) angular dimensions=0; zero crank angle). In the case of the counterclockwise rotation of the crank arm in the front mounted geometry, the pumping unit has distance ratios within the following ranges:

TABLE III

| Front Mounted Geometry-Counterclockwise Rotation | | |
|---|---|---|
| API Dim. Ratio | Preferred Range | Broad Range |
| A/C | 1.375 to 1.525 | 1.200 to 1.900 |
| R/C | 0.258 to 0.269 | 0.250 to 0.280 |
| P/C | 1.391 to 1.447 | 1.345 to 1.505 |
| K/C | 1.316 to 1.369 | 1.275 to 1.409 |
| (H-G)/C | 1.034 to 1.142 | 0.975 to 1.165 |
| I/C | 0.747 to 0.826 | 0.700 to 0.850 |

In the case of the clockwise rotation of the crank arm in the front mounted geometry, the pumping unit has distance ratios within the following ranges:

| API Dim. Ratio | Preferred Range | Broad Range |
|---|---|---|
| A/C | 1.375 to 1.525 | 1.200 to 1.900 |
| R/C | 0.278 to 0.290 | 0.270 to 0.298 |
| P/C | 1.444 to 1.502 | 1.399 to 1.547 |
| K/C | 1.955 to 2.034 | 1.894 to 2.094 |
| (H-G)/C | 1.641 to 1.813 | 1.468 to 2.000 |
| I/C | 0.947 to 1.047 | 0.847 to 1.150 |

$K = [(H-G)^2 + I^2]^{\frac{1}{2}}$ - This relationship must always be true for all pumping units in both the front mounted and rear mounted geometry embodiments.

I claim:

1. In a rear mounted geometry pumping unit for reciprocation of a well string, said pumping unit including a walking beam, an arc attached to one end of said walking beam, said arc being adapted for connection to said well string, means for oscillation of said walking beam connected to an opposite end of said walking beam from said end on which the arc is attached, means for rotatably supporting said walking beam on a horizontal axis at a location intermediate between the opposed ends thereof, said oscillation means including at least one pitman rotatably connected at one end thereof to said opposite end of the walking beam, a crank arm rotatably connected to said pitman at the other end thereof, a motor driven spindle for rotating said crank arm in circular fashion, a counterweight attached to said crank arm for rotation in circular fashion therewith, the center of gravity of said counterweight lying in a straight line direction along the axis of said crank arm, the axis of the rotatable connection between said crank arm and said pitman intersecting said straight line direction at a right angle, said pumping unit having a distance A extending from the axis B of the rotatable support for said walking beam to a point of tangency on the outer surface of said arc which lies in the direction of said well string, a distance C extending from B to the axis D of the rotatable connection of said pitman to the walking beam, a distance P extending from D to the axis E of the rotatable connection of the pitman to said crank arm, a distance R from E to the axis F of the motor driven spindle, a distance I extending from F in a horizontal direction to a point L at the intersection of a vertical direction with the axis of the rotatable support for said walking beam, a distance G from F to the ground, a distance H-G from B to L, and a distance K from F to B, the improvement in said pumping unit which comprises:

(a) in the case of counterclockwise rotation of said crank arm, said counterclockwise direction being defined by viewing said pumping unit from a location in which the well is on the right and said oscillation means is on the left;

said pumping unit having distance ratios within the following ranges:

A/C: 0.800 to 1.600
R/C: 0.337 to 0.373
P/C: 1.345 to 1.490
K/C: 1.309 to 1.447
(H-G)/C: 1.042 to 1.410
I/C: 0.535 to 0.723, and (b) in the case of clockwise rotation of said crank arm, said pumping unit having distance ratios within the following ranges:

A/C: 0.800 to 1.550
R/C: 0.362 to 0.400
P/C: 1.416 to 1.566
K/C: 1.894 to 2.094
(H-G)/C: 1.468 to 1.986
I/C: 0.847 to 1.147.

2. In a front mounted geometry pumping unit for reciprocation of a well string, said pumping unit including a walking beam, an arc attached to one end of said walking beam, said arc being adapted for connection to said well string, means for rotatably supporting said walking beam on a horizontal axis adjacent to an opposite end of said walking beam from said end to which the arc is attached, oscillation means connected to said walking beam at a location intermediate between said support means and said arc, said oscillation means including at least one pitman rotatably connected at one end thereof to said walking beam, a crank arm rotatably connected to said pitman at the other end thereof, a motor-driven spindle for rotating said crank arm in circular fashion in a counterclockwise direction, said direction being defined by viewing said pumping unit from a location in which the well is on the right, a counterweight attached to said crank arm for rotation therewith, the center of gravity of said counterweight lying in a straight line direction along the axis of said crank arm, the axis of the rotatable connection between said crank arm and said pitman intersecting said straight line direction at a right angle, said pumping unit having a distance A extending from the axis B of the rotatable support for said walking beam to a point of tangency on the outer surface of said arc which lies in the direction of the well string, a distance C extending from B to the axis D of the rotatable connection of said pitman to the walking beam, a distance P extending from D to the axis E of the rotatable connection of the pitman to said crank arm, a distance R from E to the axis F of the motor driven spindle, a distance I extending from F in a horizontal direction to a point L at the intersection of a vertical direction with the axis of the rotatable support for said walking beam, a distance G from F to the ground, a distance H-G from B to L, and a distance K from F to B, the improvement in said pumping unit which comprises:

(a) in the case of counterclockwise rotation and said crank arms, said pumping unit having distance ratios within the following ranges:

A/C: 1.200 to 1.900
R/C: 0.250 to 0.280
P/C: 1.345 to 1.505
K/C: 1.275 to 1.409
(H-G)/C: 0.975 to 1.165
I/C: 0.700 to 0.850, and (b) in the case of clockwise rotation of said crank arm, said pumping unit having distance ratios within the following ranges:

A/C: 1.200 to 1.900
R/C: 0.270 to 0.298
P/C: 1.399 to 1.547
K/C: 1.894 to 2.094
(H-G)/C: 1.468 to 2.000
I/C: 0.847 to 1.150

3. The improved pumping unit of claim 1 wherein (a) in the case of counterclockwise rotation of said crank arm, said pumping unit has distance ratios within the following ranges:

A/C: 0.926 to 1.318
R/C: 0.351 to 0.359
P/C: 1.405 to 1.433
K/C: 1.364 to 1.392
(H-G)/C: 1.164 to 1.287
I/C: 0.598 to 0.660, and (b) in the case of clockwise rotation of the crank arm, said pumping unit has distance ratios within the following ranges:

A/C: 0.935 to 1.264
R/C: 0.377 to 0.385
P/C: 1.476 to 1.506
K/C: 1.974 to 2.014
(H-G)/C: 1.710 to 1.744
I/C: 0.987 to 1.007

4. The improved pumping unit of claim 2 wherein (a) in the case of counterclockwise rotation of said crank arm, said pumping unit has distance ratios within the following ranges:

A/C: 1.375 to 1.525
R/C: 0.258 to 0.269
P/C: 1.391 to 1.447
K/C: 1.316 to 1.369
(H-G)/C: 1.034 to 1.142
I/C: 0.747 to 0.826, and (b) in the case of clockwise rotation of said crank arm, said pumping unit having distance ratios within the following ranges:

A/C: 1.375 to 1.525
R/C: 0.278 to 0.290
P/C: 1.444 to 1.502
K/C: 1.955 to 2.034
(H-G)/C: 1.641 to 1.813
I/C: 0.947 to 1.047.

* * * * *